United States Patent [19]

Sheu

[11] Patent Number: 5,074,164

[45] Date of Patent: Dec. 24, 1991

[54] ANGLE POSITIONING DEVICE

[76] Inventor: Yin-Ping Sheu, Fl. 11-7, No. 3, Fu-Hsing Erh Rd., Kaohsiung, Taiwan

[21] Appl. No.: 651,542

[22] Filed: Feb. 6, 1991

[51] Int. Cl.[5] ..... G05G 5/06

[52] U.S. Cl. ..... 74/527; 16/349

[58] Field of Search ..... 74/527; 16/348, 349, 16/386; 292/DIG. 17

[56] References Cited

U.S. PATENT DOCUMENTS 4,564,974 1/1986 McGail et al. ..... 16/349 X 4,566,150 1/1986 Boothe ..... 16/349 X

*Primary Examiner*—Dirk Wright

[57] ABSTRACT

A device for positioning a rotary member at a desired angle relative to a fixed member includes a first shaft sleeve mounted in the rotary member, and a second shaft sleeve mounted in the fixed member adjacent to and axially aligned with the first shaft sleeve. The first and second shaft sleeves have a plurality of inward and axially extending clutch teeth notches. A shaft member has a first section slidably mounted in and extending through the first shaft sleeve, a second section slidably disposed in the second shaft sleeve, and a central section connecting the first and second sections and having a plurality of axially extending and outwardly projecting clutch teeth protrusions. The shaft member is slidable between the first and second shaft sleeves to interengage or disengage the first and second shaft sleeves. The central section is moved towards the first shaft sleeve to disengage the central section from the second shaft sleeve, and towards the second shaft sleeve to engage the central section and the second shaft sleeve.

5 Claims, 7 Drawing Sheets

ANGLE POSITIONING DEVICE

BACKGROUND OF THE INVENTION

1. Field of The Invention

The invention relates to a positioning device, more particularly to a device for adjustably positioning a rotary member at a desired angle relative to a fixed member.

2. Description Of The Related Art

FIG. 1 is an illustration of a window and window frame mounting arrangement commonly employed ih high-rise buildings. The window 12 is rotatable relative to the window frame 10 about a pair of axially aligned mounting posts 16*a* and 16*b* provided between the window frame 10 and the window 12. The two vertical sides of the window 12 are provided with lock devices 18*a* and 18*b* to keep the window 12 in the closed position. Referring to FIG. 2, to open the window 12, the lock devices 18*a* and 18*b* are unlocked, and the window 12 is rotated about the axis of the mouting posts 16*a* and 16*b*.

A main disadvantage of the above window and window frame arrangement is that the window 12 cannot be locked at the desired open position.

SUMMARY OF THE INVENTION

Therefore, the objective of the present invention is to provide a device for adjustably positioning a rotary member at a desired angle relative to a fixed member.

Accordingly, the preferred embodiment of a device, for positioning a rotary member at a desired angle relative to a fixed member, of the present invention comprises a first shaft sleeve mounted in the rotary member and having a plurality of inward and axially extending first clutch teeth notches, and a second shaft sleeve mounted in the fixed member adjacent to and axially aligned with the first shaft sleeve. The second shaft sleeve also has a plurality of inward and axially extending second clutch teeth notches. A shaft member has a first section slidably mounted in an extending through the first shaft sleeve, a second section slidably disposed in the second shaft sleeve, and a central section connecting the first and second sections and having a plurality of axially extending and outwardly projecting clutch teeth protrusions. The shaft member is sliadable between the first and second shaft sleeves to interengage or disengage the first and second shaft sleeves. A shaft control means is connected to the first section and is operated to move the central section fully into the first shaft sleeve, disengaging the central section from the second shaft sleeve, or to move the central section towards the second shaft sleeve so that the central section is disposed partly in the first shaft sleeve and partly in the second shaft sleeve, thus interengaging the first and second shaft sleeves.

BRIEF DESCRIPTION OF THE DRAWINGS

Other features and advantages of the present invention will become apparent in the following detailed description of the preferred embodiments with reference to the accompany drawings, of which.

DETAILED DESCRIPTION OF THE PREFERRED EMBODIMENT

Figure 1:
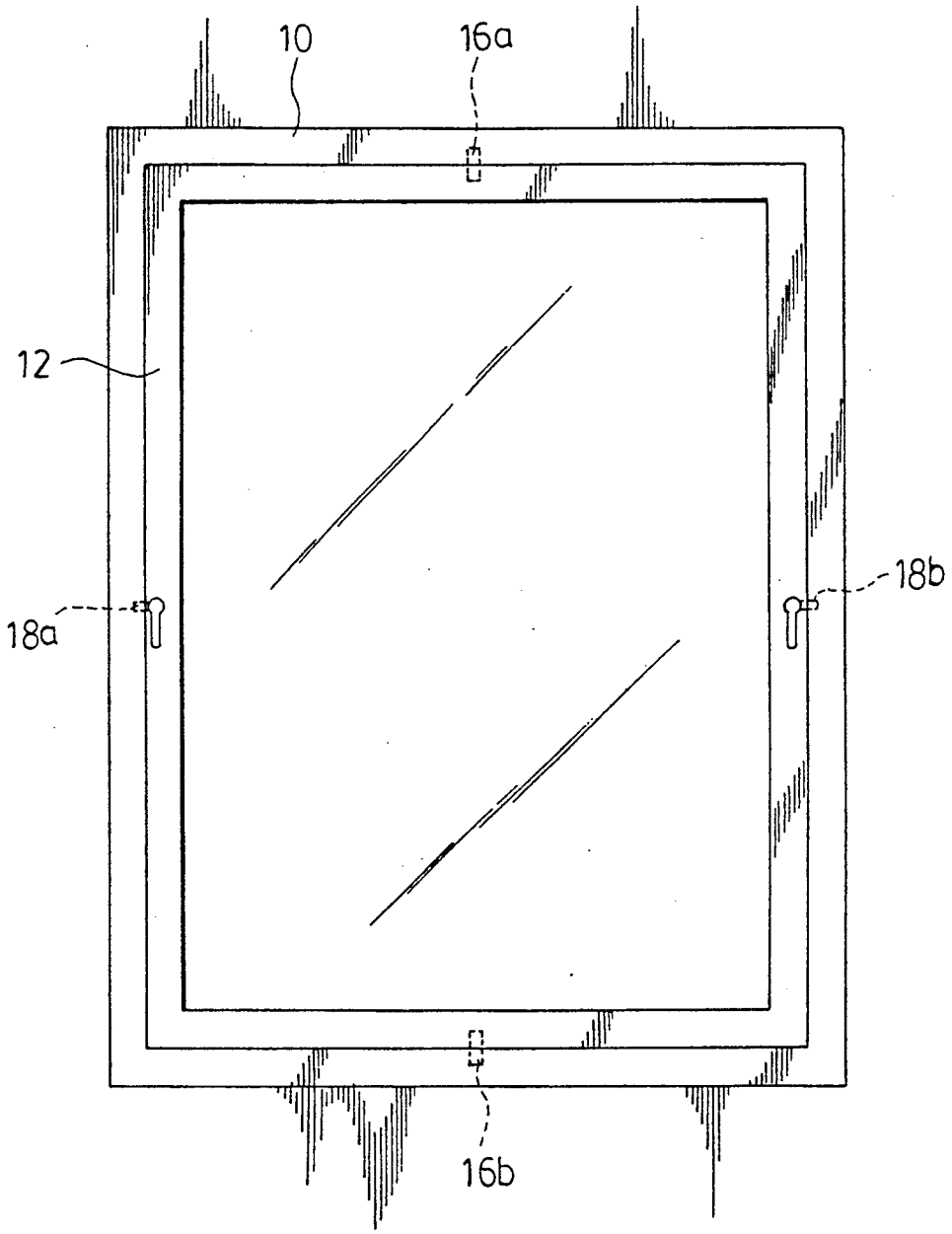
FIG. 1 PRIOR ART
FIG. 1 is front view illustrating a window and window frame mounting arrangement commonly employed in high-rise buildings.
Figure 2:
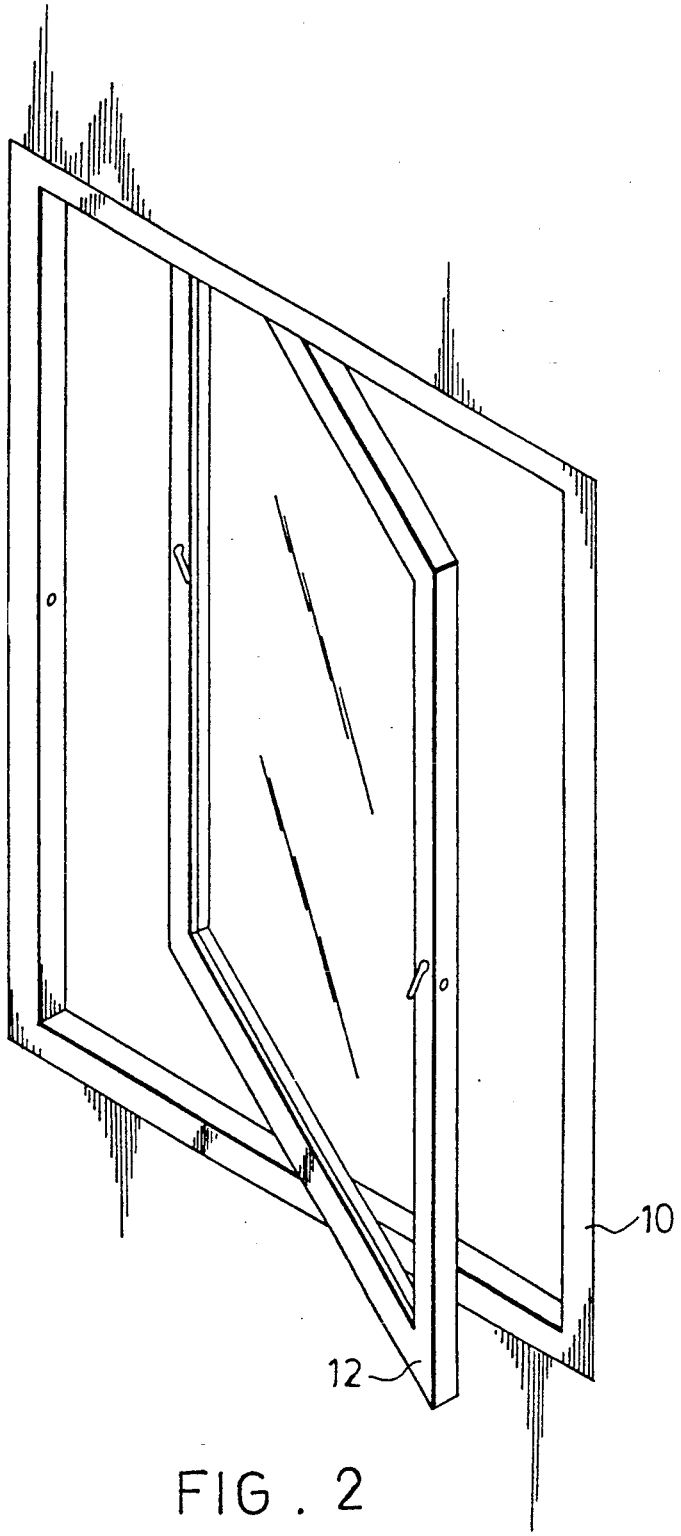
FIG. 2 PRIOR ART
FIG. 2 is a perspective view of the window and window frame arrangement shown in FIG. 1 when the window is in an open position.
Figure 3:
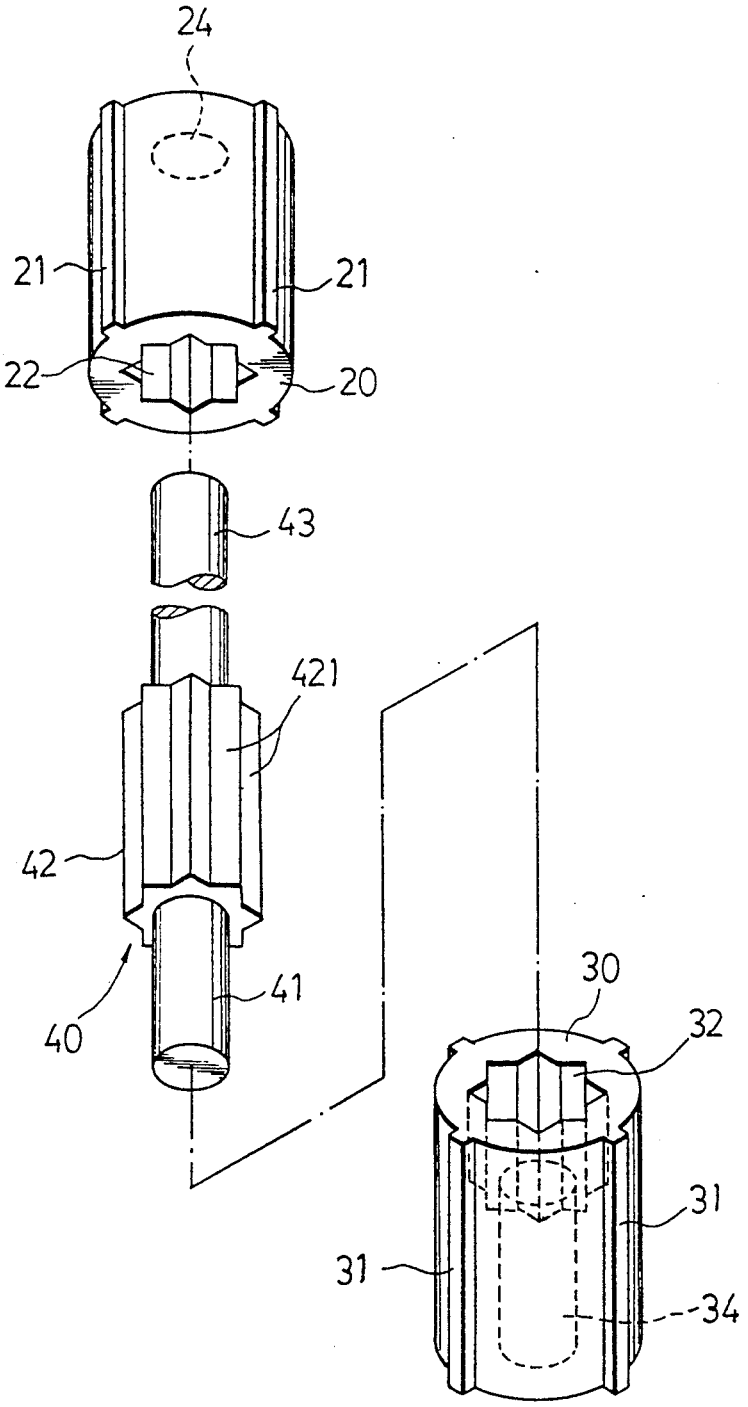
FIG. 3 is an exploded view of the first preferred embodiment of an angle positioning device according to the present invention.
Figure 4:
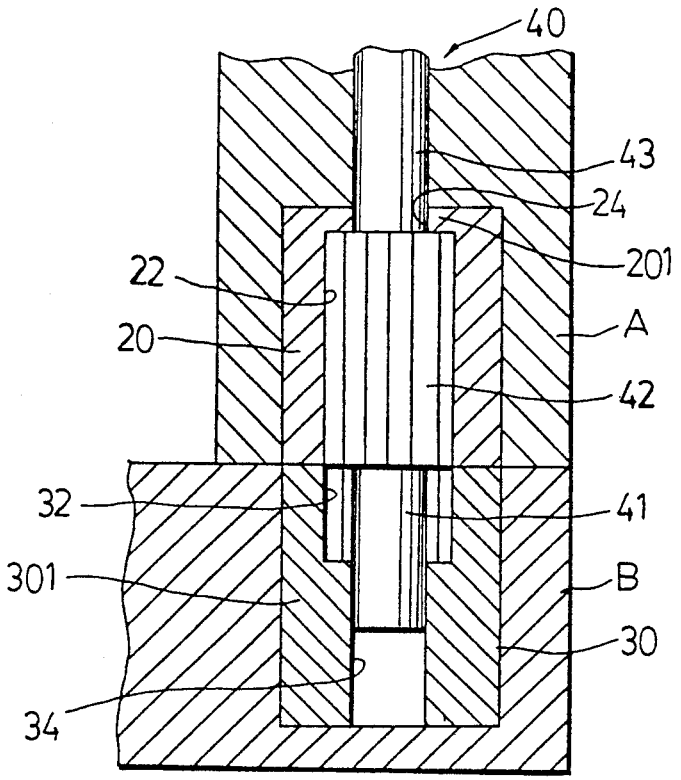
FIG. 4 is a section of the assembled preferred embodiment when in an unlocked position.

Referring to FIGS. 3 and 4, the preferred embodiment mainly comprises a first shaft sleeve 20, a second shaft sleeve 30, and a shaft member 40.

The first and second shaft sleeves 20 and 30 are substantially cylindrical in shape and are provided with a plurality of outwardly and axially extending rib projections 21 and 31, and a plurality of inward and axially extending clutch teeth notches 22 and 32. The shaft member 40 has central section 42 provided with a plurality of axially extending and outwardly projecting clutch teeth protrusions 421 to engage the clutch teeth notches 22 and 32. The cross sections of the clutch teeth notches 22 and 32, and the clutch teeth projections 421 on a plane transverse to the axis of the shaft member 40 are substantially triangular in shape.

The first shaft sleeve 20 is to be mounted in a rotary member A, while the second shaft sleeve 30 is to be mounted in a fixed member B at a position adjacent to and axially aligned with the first shaft sleeve 20. The rib projections 21 and 31 prevent rotation of the first and second shaft sleeves 20 and 30 relative to the rotary member A and the fixed member B, respectively. The shaft member 40 has a first section 43 extending into the first shaft sleeve 20. A radial flange 201 projects inward from one end of the first shaft sleeve 20 opposite the second shaft sleeve 30. The first section 43 extends through an axial opening 24 defined by the radial flange 201. The lower portion of the second shaft sleeve 30 is provided with an inward radial flange 301 defining a restricted opening 34. The shaft member 40 has a second section 41 slidingly extending into the restricted opening 34.

Figure 5:
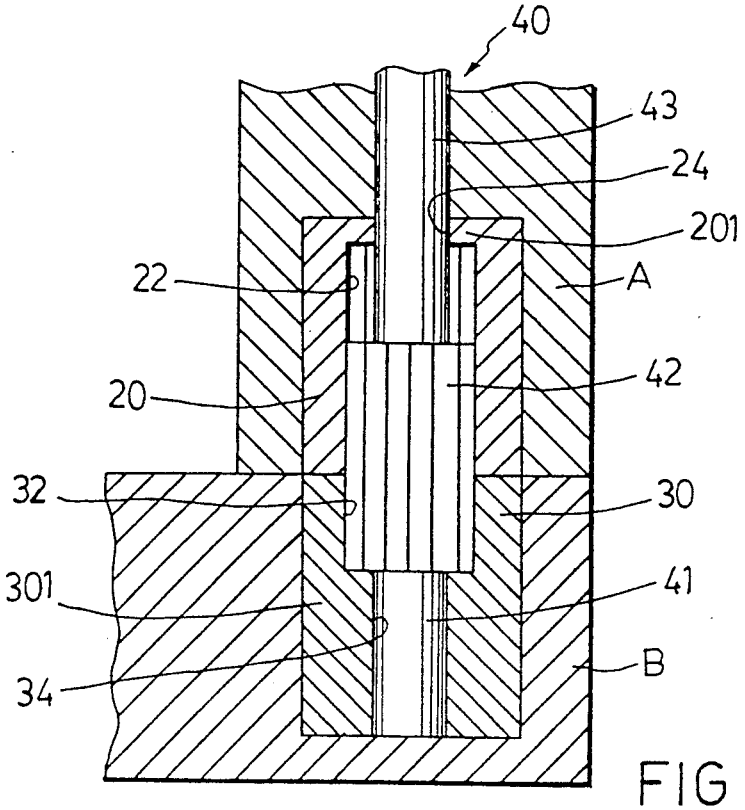
FIG. 5 is a section of the assembled preferred embodiment when in a locked position.

To position the rotary member A at a desired angle relative to the fixed member B, the shaft member 40 is moved toward the second shaft sleeve 30, as shown in FIG. 5, so that a portion of the portion of the central section 42 engages the clutch teeth notches 32 of the second shaft sleeve 30, while another portion of the central section 42 engages the clutch teeth notches 22 of the first shaft sleever 20. The second shaft sleeve 30 is fixed, and thus prevents rotation of the shaft member 40, thereby locking the rotary member A to the fixed member B.

To adjust the position of the rotary member A relative to the fixed member B, the shaft member 40 is moved fully out of the second shaft sleeve 30 so that the central section 42 does not engage the clutch teeth notches 32. The shaft member 40 can now rotate with the rotary member A.

Figure 6:
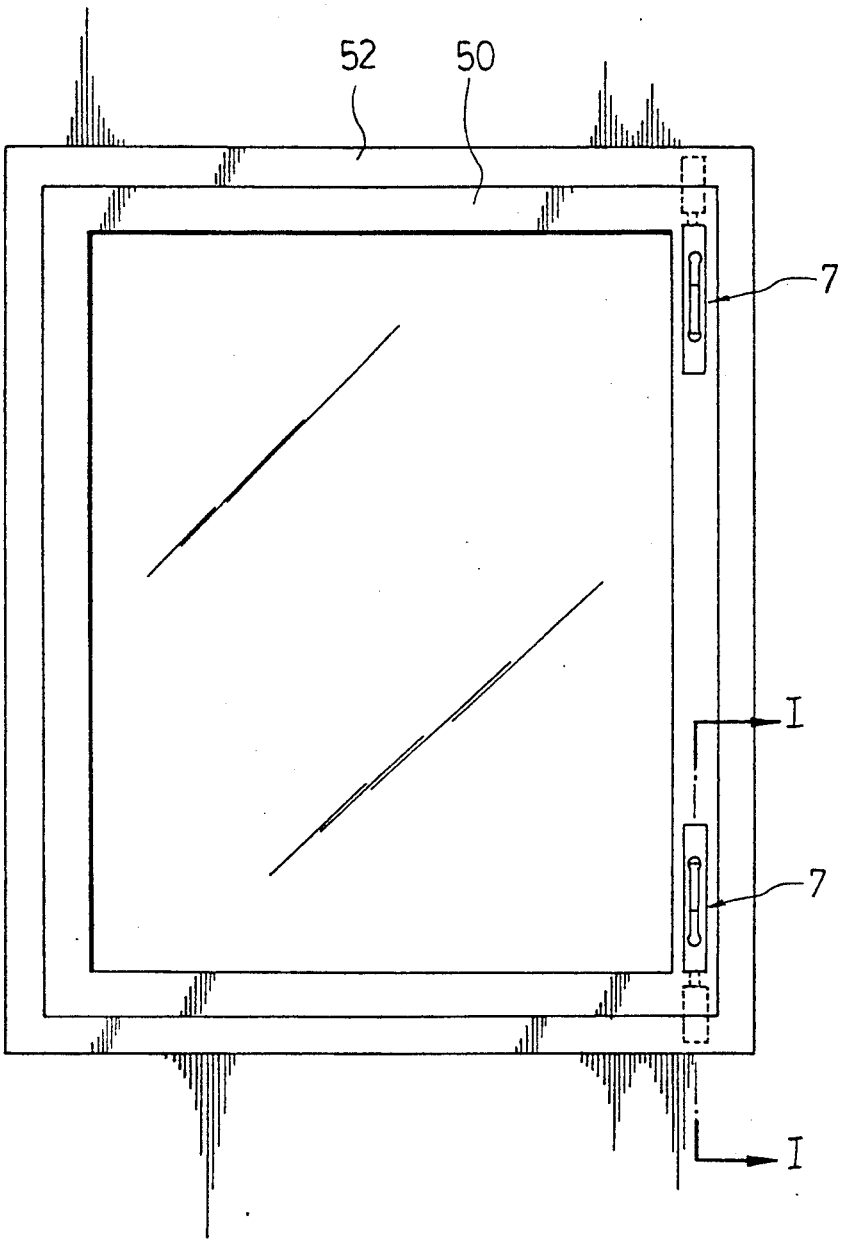
FIG. 6 is an illustration of the preferred embodiment when used to mount a window on a window frame.

Referring to FIG. 6, the preferred embodiment can be used to mount a window 50 on a window frame 52. A pair of axially aligned angle positioning devices of the present invention are provided on the upper and lower right hand corners of the window 50 and the window frame 52. Shaft control devices 7 are used to lock or unlock the angle positioning devices. When the angle positioning devices are unlocked, the window 50 can be opened by rotating the same about the axis of the angle positioning devices.

Figure 7:
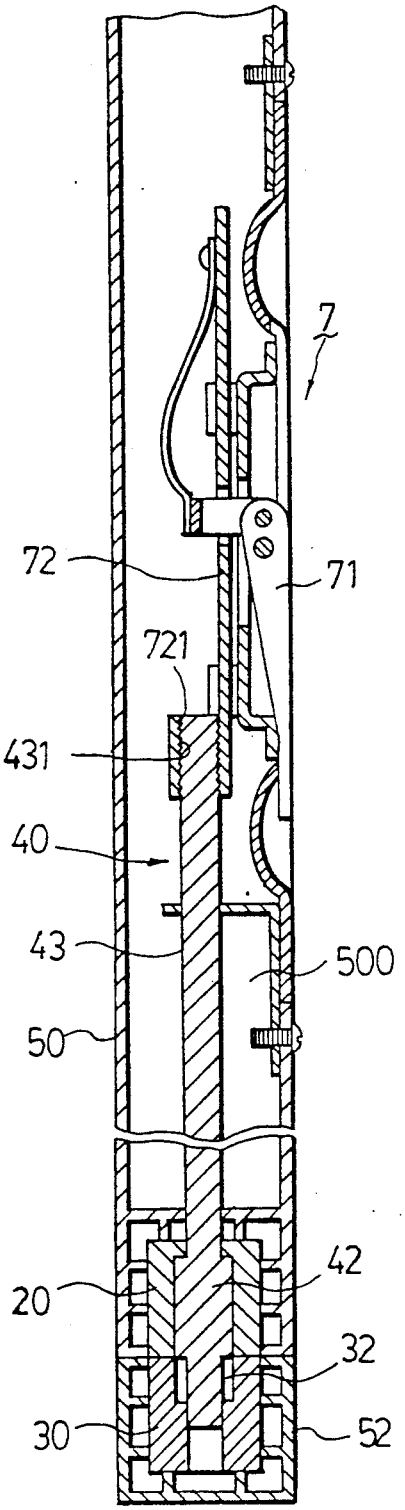
FIG. 7 is an I—I section of FIG. 6 illustrating the preferred embodiment when in an unlocked position.
Figure 8:
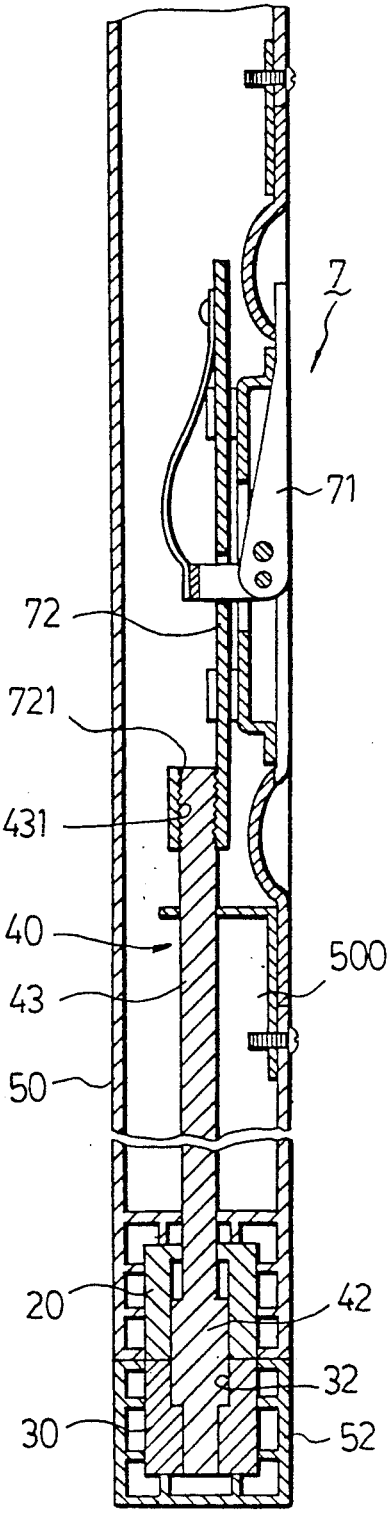
FIG. 8 is an I—I section of FIG. 6 illustrating the preferred embodiment when in a locked position.

FIGS. 7 and 8 are I—I sections of FIG. 6. The preferred embodiment is mounted on a hollow section 500 of the window 50. The first section 43 of the shaft member 40 extends into the hollow section 500 of the window 50. The shaft control device 7 comprises a guide member 72 disposed inside the hollow section 500 and having rack teeth 721 to engage rack teeth 431 provided on a distal end of the first section 43. A lever member 71 is pivoted in the window 50 and is connected to the guide member 72. The lever member 71 can be placed in either of two positions to correspondingly move the guide member 72 downward or upward.

Referring once more to FIG. 7, when the lever member 71 is placed in the lower position, the guide member 72 is moved axially upward by a predetermined distance, pulling the shaft member 40 so that the central section 42 disengages the second shaft sleeve 30. The window 50 can now be rotated relative to the window frame 52.

Referring once more to FIG. 8, when the lever member 71 is placed in the upper position, the guide member 72 is moved axially downward by a predetermined distance to correspondingly move the shaft member 40 so that its central section 42 engages both the first and second shaft sleeves 20 and 30. The second shaft sleeve 30 prevents rotation of the shaft member 40 to thereby lock the window 50 in the desired position relative to the window frame 52.

Figure 9:
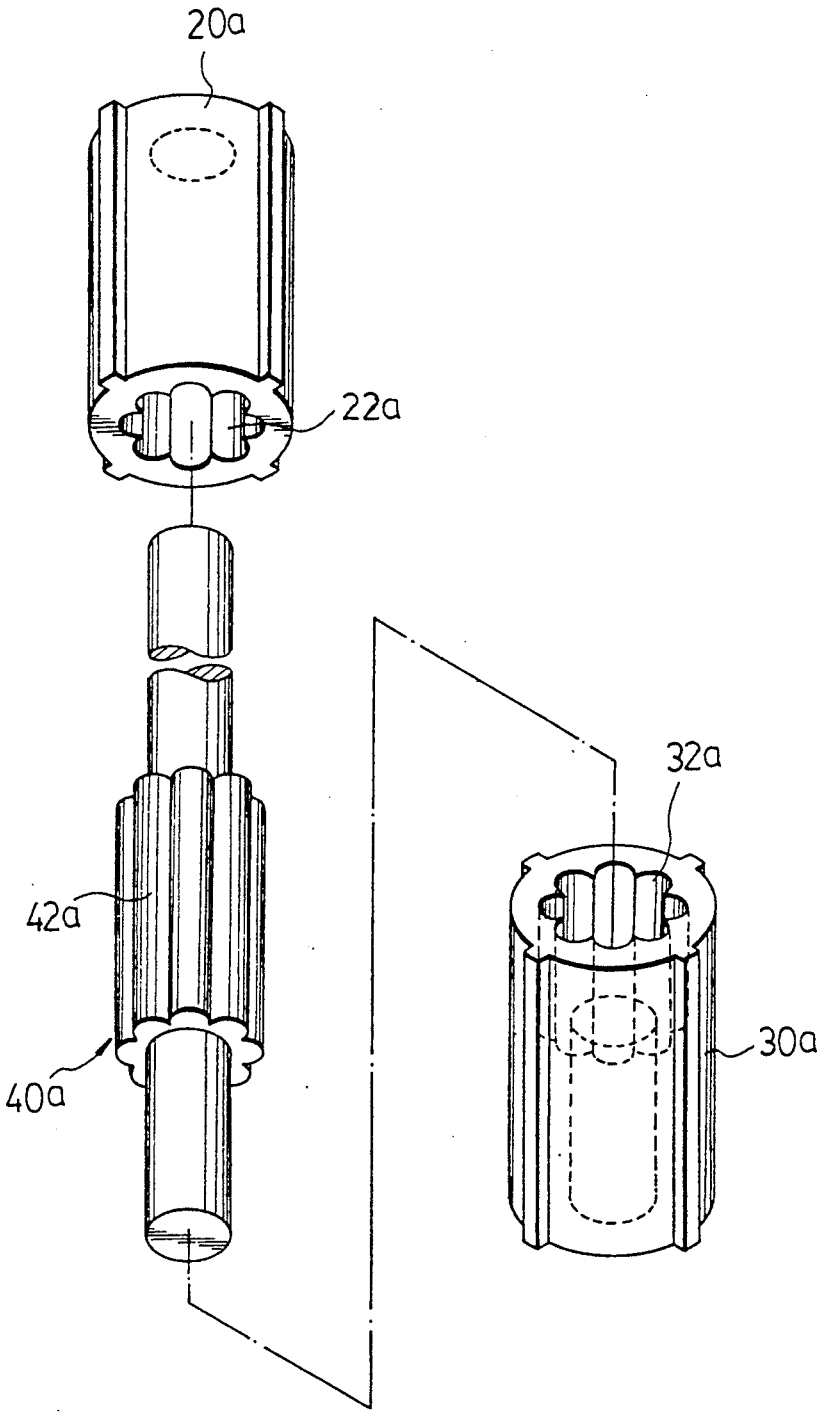
FIG. 9 is an exploded view of the second preferred embodiment of an angle positioning device according to the present invention.

Referring to FIG. 9, the second preferred embodiment of an angle positioning device according to the present invention is shown to similarly comprise first and second shaft sleeves 20*a* and 30*a*, and a shaft member 40*a*. The clutch teeth notches 22*a* and 32*a* of the first and second shaft sleeves 20*a* and 30*a*, and the clutch teeth protrusions 42*a* of the shaft member 40*a* are substantially rounded, in contrast with those of the first preferred embodiment. The operation of the second preferred embodiment is similar to that of the first preferred embodiment and will not be detailed further.

The use of the preferred embodiment should not be limited to window arrangments. The preferred embodiment can also be incorporated in doors, car seats, motorcycles, bicycles, strollers, etc.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A device for positioning a rotary member at a desired angle relative to a fixed member, comprising:

a first shaft sleeve mounted in the rotary member;

a second shaft sleeve mounted in the fixed member adjacent to and axially aligned with said first shaft sleeve;

a shaft member having a first section slidably mounted in and extending through said first shaft sleeve, a second section slidably disposed in said second shaft sleeve, and a central section connecting said first and said second sections, one of said first and second shaft sleeves and said central section having a plurality of axially extending clutch teeth notches, the other one of said first and second shaft sleeves and said central section having a plurality of axially extending clutch teeth protrusions to engage said clutch teeth notches, said shaft member being slidable between said first and said second shaft sleeves to interengage or disengage said first and said second shaft sleeves; and a shaft control means connected to said first section and operated to move said central section out of said second shaft sleeve to disengage said central section from said second shaft sleeve, or to move said central section towards said second shaft sleeve to engage said central section and said second shaft sleeve.

2. The device as claimed in claim 1, wherein the cross section of said clutch teeth protrusions on a plane transverse to the axis of said shaft member is substantially triangular in shape.

3. The device as claimed in claim 1, wherein said clutch teeth protrusions are rounded teeth protrusions.

4. The device as claimed in claim 1, wherein said second shaft sleeve has an end portion provided with an inward radial flange, said second section of said shaft member slidingly extends into said inward radial flange.

5. The device as claimed in claim 1, wherein said rotary member has hollow section adjacent said first section, said first section having an end portion provided with first rack teeth and extending into said hollow section, said shaft control means comprising a guide member disposed inside said hollow section and having second rack teeth to engage said first rack teeth, and a lever member pivoted on said rotary member and connected to said guide member to move said guide member.

* * * * *